United States Patent [19]

Jordan

[11] Patent Number: 4,463,953

[45] Date of Patent: Aug. 7, 1984

[54] ARCHERY POD

[76] Inventor: William R. Jordan, c/o Leon Jordan Marine, 3902 Columbus-Manchester Expressway, Columbus, Ga. 31904

[21] Appl. No.: 496,657

[22] Filed: May 20, 1983

[51] Int. Cl.[3] ..... F41B 5/02

[52] U.S. Cl. ..... 273/418

[58] Field of Search ..... 273/418, 419

[56] References Cited

U.S. PATENT DOCUMENTS 3,457,921 7/1969 Waldeisen ..... 273/418 X 4,380,340 4/1983 Simo ..... 273/419 X

*Primary Examiner*—Paul E. Shapiro

*Attorney, Agent, or Firm*—Watson, Cole, Grindle & Watson

[57] ABSTRACT

An apparatus adapted to be mounted upon an aerial projectile for releasing a drug within the body of a game animal includes a first cylindrical member having first and second axially spaced flanges, and a second cylindrical member concentrically disposed around the first cylindrical member so as to form an annular chamber for the storage of the drug. The apparatus exhibits complete axial symmetry so as to enhance the aerodynamic stability of the projectile during flight.

6 Claims, 4 Drawing Figures

ARCHERY POD

BACKGROUND OF THE INVENTION

1. Field of the Invention

This invention relates generally to an apparatus for administering a substance beneath the surface of a target, and more particularly to an apparatus adapted to be mounted upon an aerial projectile for releasing a drug within the body of a game animal.

2. Description of the Prior Art

In the field of archery and in the practice of bow hunting, numerous problems have arisen concerning the maiming of game as a result of inaccurately directed arrows causing the maiming of game. Typically, an animal wounded by a poorly aimed arrow will escape only to experience prolonged suffering. Attempts have been made to prevent such suffering by providing various attachments about the proximity of the arrowhead for releasing upon impact a chemical or drug within the animal. However, such attempts have been less than completely satisfactory in that the prior art devices typically generate aerodynamic instabilities during the flight of the arrow, necessitate a complicated assembly and structure, or require specialized, non-standard arrows or arrowheads.

A device generally directed to the dispensing of a drug in the surface tissues of an animal is disclosed by Hollingsworth in U.S. Pat. No. 3,383,866, which depicts an arrowhead formed in a unitary construction with a cylindrical shank having forward and rearward diametrically enlarged flange portions adapted to receive an O-ring. The shank of the arrowhead is fitted within a tubular member so as to form an annular chamber for the storage of a fluid material. The tubular member is provided with a pair of diametrically opposed outwardly projecting abutment members which, upon impact with the target, effect the separation of the tubular member and shank so as to release the drug within the animal. Such construction requires the use of a specialized arrowhead thereby precluding the use of standard off-the-shelf arrowheads. In addition, the outwardly projecting abutment members may create aerodynamic instabilities depending upon their orientation with respect to the arrowhead and may cause severe deflection of the arrow upon grazing an obstacle such as a tree branch.

Another drug dispensing apparatus for a hunting arrow is disclosed by Benke in U.S. Pat. No. 4,174,837. The apparatus is adapted to be attached to the shaft of an arrow by sliding the apparatus over the forward end of the arrow shaft and mounting the arrowhead thereon. An outer tubular jacket coacts with an inner cylinder fitted with outwardly and forwardly extending barbed members. The inner cylinder is slidable within the outer tubular jacket as well as slidable over the arrow shaft. The outer jacket is driven below the surface of the target by the arrow shaft while the barbed outwardly projecting members secure the inner cylinder within the surface tissues of the animal thereby effecting the separation of the arrow jacket from the inner cylinder and thereby releasing the drug within the animal.

Yet another device directed to a drug dispensing hunting arrow is shown by Bear in U.S. Pat. No. 3,565,435, wherein a pod assembly is permanently secured to the forward end of an arrow shaft. A plurality of radially extending fins are provided within the central portion of the pod for forming a plurality of cavities for retaining the drug to be dispensed. A stretchable flexible rubberlike sheath is provided over the outer surfaces of the fins for enclosing the drug therein. The sheath is stripped back by frictional resistance upon impact with the target. The assembly is relatively complicated in structure and is not adaptable to interchange with standard broadhead arrow tips.

Thus, there exists the need for an apparatus for administering a drug within the tissues of a game animal via an aerial projectile, which apparatus is aerodynamically stable, of simple construction, and adapted to function with any standard hunting arrow shaft and arrowhead assembly, as well as to realize the numerous objects discussed below.

SUMMARY OF THE INVENTION

Accordingly, this invention has been made to overcome the problems discussed above, and therefore has an object to provide an apparatus adapted to be quickly and easily attached to the shaft as an aerial projectile, such as an arrow, for the administration of a substance beneath the surface of a target.

A further object is to enhance the aerodynamic stability of an aerial projectile equipped with such apparatus.

Yet another object is to provide a demountable apparatus of the type described above which facilitates the interchange of various arrow tips upon the same shaft equipped with the device; for example, field tips, target tips and hunting tips.

A still further object of the invention is to provide an apparatus of the above described type which is of relatively simple and inexpensive construction.

The foregoing and other objects are achieved according to the present invention by the provision of an archery pod composed of two coacting main components, each of which is of a simple structural construction and each of which is entirely symmetric about the axis of the arrow shaft so as to enhance the aerodynamic stability of the arrow during flight. An inner tubular member is provided with a forward and a rearward outwardly extending flange. The innner tubular member is fitted within an outer tubular jacket so as to form an annular chamber therebetween for the storage of the substance to be administered.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

Figure 1:
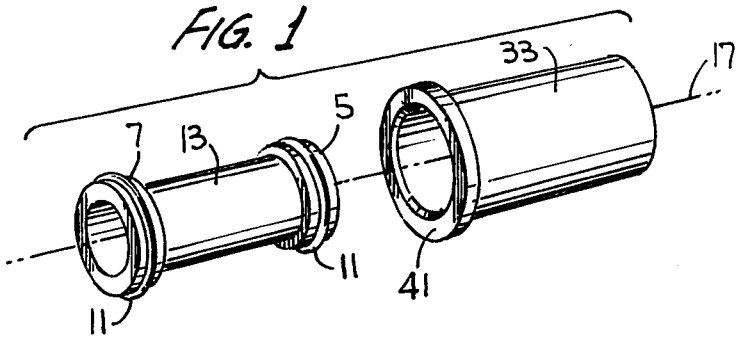
FIG. 1 is an exploded isometric view of the main components of the invention.

The archery pod apparatus developed in accordance with the present invention will now be described in conjunction with the accompanying FIGS. 1 and 2, within which the pod assembly 1 is shown to include an inner central tubular cylindrical member 3 having a first or leading annular flange 5 integrally formed thereon at one end portion of the central tubular member and further includes a second or trailing annular flange 7 provided thereon at an opposing axial end portion thereof so as to define a spool-like structure. The flanges may be formed with identical dimensions to facilitate manufacture, assembly and use of the archery pod 1.

Both the leading 5 and trailing 7 annular flanges may be formed with circumferentially extending annular grooves 9 for receiving therein a sealing member 11, such as an O-ring. The central inner tubular member 3 may be formed such that the main body portion 13 thereof is of a uniform diameter along its axial extent. In addition, the leading 5 and trailing 7 annular flanges and grooves 9 may also be formed of uniform and equal diameters so as to symmetrically project radially outwardly from opposing end portions of the main body 13 of the central inner tubular member 3 so as to result in a structure having longitudinal or axial symmetry. Such symmetry is critical for the maintenance of aerodynamic stability of an aerial projectile adapted with the archery pod of the instant invention. It can also be readily appreciated that such symmetrical construction facilitates the manufacture and assembly of the archery pod.

Figure 2:
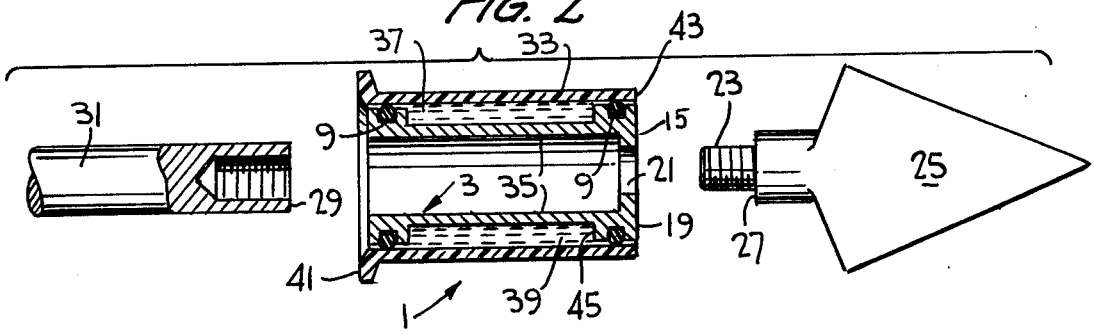
FIG. 2 is a sectional elevation view of the invention depicting the storage of the material within the pod assembly and the relative position of the pod with respect to the arrow shaft and arrowhead.

As shown in the sectional view of FIG. 2, the central inner tubular member 3 further includes a radially inwardly projecting annular flange 15 formed about the forward or leading end portion of the main body 13 adjacent the leading annular flange 5. The leading annular flange 5 and the radially inwardly projecting annular flange 15 may be formed such that their leading or forward axial end surface portions lie within the same plane perpendicular to the longitudinal axis 17 of the archery pod assembly so as to define a front wall portion 19 of the central tubular member 3.

The front wall 19 is provided with a central bore 21, the wall of which bore defines the inner circumference of the inwardly projecting annular flange 15. The diameter of the central bore 21 is dimensioned so as to allow the threaded shank 23 of arrowhead 25 to pass therethrough such that shoulder 27 on arrowhead 25 abuts the front wall 19 of the central tubular member 3.

The inner diameter of the central tubular member 3 is dimensioned so as to form a pocket with the inwardly projecting annular flange to receive therein the forward or leading end 29 of arrow shaft 31. A slight clearance may be provided between the inner diameter of the central tubular member 3 and the outer diameter of arrow shaft 31 to facilitate a sliding fit therebetween.

An outer tubular jacket 33 is dimensioned so as to provide for a sliding and sealing engagement of the sealing members 11 of the central tubular member 3 along the inner wall 35 of the tubular jacket 33. Upon sliding engagement of the tubular jacket 33 with the central tubular member 3, an annular chamber 37 is formed therebetween for the storage of a substance 39 to be released upon impact with a target. The rear or trailing axial end portion of the tubular jacket 33 is provided with a radially outwardly extending peripheral flange 41. Flange 41 may have a frusto-conical cross section as shown in FIG. 2 for minimizing air resistance and enhancing aerodynamic stability during the flight of a projectile fitted with the archery pod 1. Flange 41 serves as an abutment surface for preventing any significant penetration of the tubular jacket 33 beneath the surface of the target, thereby effecting the separation of the central tubular member 3 from the tubular jacket 33 so as to release the substance 39 beneath the surface of the target.

In use, the tubular jacket 33 is slipped over the central cylindrical member 3 so as to leave a small axial clearance between the leading end 43 of the tubular jacket 33 and the rear wall 45 of the leading annular flange 5. The material or substance 39 is then poured through the clearance into the annular chamber 37 and upon filling chamber 37 with the material 39, the tubular jacket 33 is further slipped in an axially forward direction over the inner tubular member 3 so as to sealingly engage the sealing member 11 and the leading annular flange 5 with the leading end of the tubular jacket 33 so as to encapsulate the material 39 within the annular chamber 37.

Alternatively, the tubular jacket 33 may be slipped over the central cylindrical member 3 so as to leave a small axial clearance between the peripheral flange 41 and the trailing annular flange 7. The archery pod may then be loaded substantially as described above. In addition, the peripheral flange 41 may be internally chamfered as shown in FIG. 2 so as to form an annular funnel-shaped surface converging toward the center of the outer tubular jacket 33. The chamfer on funnel surface facilitates loading of the substance 39 into the annular chamber 37.

After loading the archery pod 1 as described above, the pod assembly is then mounted upon an aerial projectile, such as an arrow, by sliding the central cylindrical member 3 over the leading end 29 of shaft 31. The threaded shank 23 of arrowhead 25 is then threadingly engaged within a threaded recess 47 typically formed within the leading end 29 of shaft 31. In this manner, the archery pod is firmly secured between the leading end 29 of shaft 31 and the shoulder 27 provided upon the shank 23 of the arrowhead 25.

In light of the description of the assembly set forth above, it can be seen that the archery pod may be quickly and conveniently placed in an operative mode upon any standard aerial projectile shaft and that the structure of the archery pod facilitates the rapid interchange of projectile tips, for example, the change from a target arrowhead to a hunting arrowhead.

Figure 3:
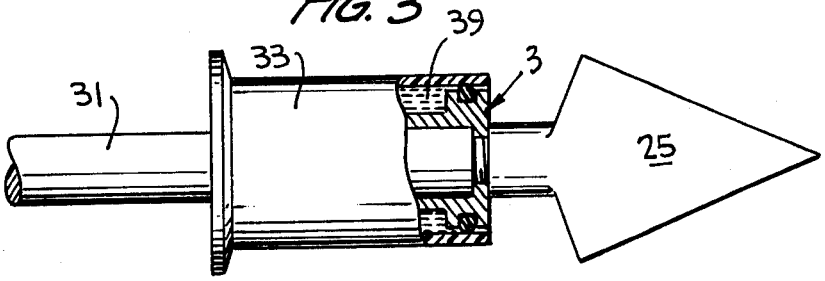
FIG. 3 shows the invention in an operative mode mounted upon an arrow.

As seen in FIG. 3, the attachment of the archery pod 1 to the aerial projectile results in an aerodynamically stable configuration which minimizes the frictional drag of the projectile through the air. Moreover, the absence of any projections of significant dimensions in a direction radially outwardly from the tubular jacket precludes such projections causing the deflection of the projectile upon grazing a tree branch of similar obstacle during flight. That is, the peripheral flange 41 of the tubular jacket 33 extends outwardly only to a moderate extent so as to achieve the objects stated above.

Figure 4:
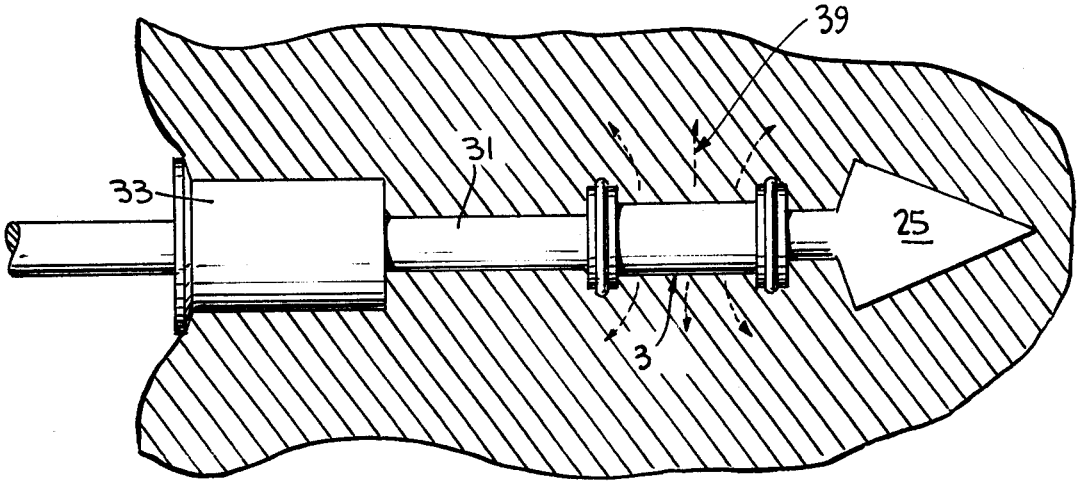
FIG. 4 shows the invention dispensing a substance beneath the surface of a target.

As can be appreciated from the cross section shown in FIG. 4, upon impact of the arrowhead 25 with the target surface 49, both the inner tubular member 3 and the tubular jacket 33 begin to penetrate the target surface 49. However, upon contact of the peripheral flange 41 of the tubular jacket 33 with the target surface 49, the forward travel of the tubular jacket 33 is arrested while the leading end 29 of the arrow shaft 31 forces the inner tubular member 3 beneath the surface of the target thereby separating the inner tubular member 3 from the tubular jacket 33 so as to release the material 39 beneath the surface of the target 49.

The material 39 may typically include a respiratory drug or narcotic and the target surface may typically be that of a game animal in which case a misdirected shot which would, under normal circumstances, merely maim the animal will, with an arrow equipped with the instant invention, release such drug into the tissues or organs of the animal so as to prevent the animal from escaping, thereby ensuring a humane result.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for administering a substance beneath the surface of a target and adapted for use with an aerial projectile having a shaft, said apparatus comprising:

a first cylindrical member having a first axial end portion and a second axial end portion;

a first annular peripheral flange formed on said first axial end portion of said first cylindrical member and projecting radially outwardly therefrom;

a second annular peripheral flange formed on said second axial end portion of said first cylindrical member and projecting radially outwardly therefrom;

a third annular flange formed on said first axial end portion of said first cylindrical member and projecting radially inwardly therefrom to form a pocket within said first cylindrical member for receiving said shaft;

sealing means provided around an outer circumferential edge portion of each of said first and said second annular peripheral flanges;

a second cylindrical member having a first axial end portion and a second axial end portion and concentrically disposed around said first cylindrical member; and an annular peripheral flange formed on said second axial end portion of said second cylindrical member, wherein said first cylindrical member and said second cylindrical member define therebetween an annular chamber axially bounded within said first and second annular peripheral flanges formed on said first cylindrical member for storage of said substance, and wherein said peripheral flange formed on said second axial end portion of said second cylindrical member comprises an inner annular chamfered surface portion defining a funnel shaped region converging inwardly toward a center portion of said second cylindrical member for facilitating loading of said substance within said annular chamber.

2. The apparatus of claim 1 wherein each said outer circumferential edge portion comprises an annular groove formed therein and wherein said sealing means comprises an O-ring provided in each said annular groove.

3. The apparatus of claim 1 wherein said annular peripheral flange formed on said second cylindrical member comprises a frusto-conical cross section.

4. The apparatus of claim 1 wherein said aerial projectile further comprises an arrowhead having a shank and wherein said third annular flange formed on said first cylindrical member has a bore concentrically formed therein for receiving said shank of said arrowhead.

5. The apparatus of claim 1 wherein said first cylindrical member is formed from a metal material and wherein said second cylindrical member is formed from a plastic material.

6. The apparatus of claim 1 wherein said first cylindrical member and said second cylindrical member are each formed from a plastic material.

* * * * *